US008100477B2

(12) United States Patent
Fich

(10) Patent No.: US 8,100,477 B2
(45) Date of Patent: Jan. 24, 2012

(54) SYNCHRONIZING DEVICE FOR AN OFFICE CHAIR

(75) Inventor: Preben Bo Fich, Sandgate (GB)

(73) Assignee: IDEAssociates (IOM) Ltd., Isle of Man (GB)

( * ) Notice: Subject to any disclaimer, the term of this patent is extended or adjusted under 35 U.S.C. 154(b) by 362 days.

(21) Appl. No.: 12/446,895

(22) PCT Filed: Oct. 22, 2007

(86) PCT No.: PCT/DK2007/050151

§ 371 (c)(1),
(2), (4) Date: Jul. 23, 2009

(87) PCT Pub. No.: WO2008/049435

PCT Pub. Date: May 2, 2008

(65) Prior Publication Data

US 2010/0289309 A1 Nov. 18, 2010

(30) Foreign Application Priority Data

Oct. 23, 2006 (EP) ..... 06122760

(51) Int. Cl.
*A47C 1/024* (2006.01)

(52) U.S. Cl. ..... 297/303.5; 297/289; 297/300.2; 297/300.5; 297/300.8

(58) Field of Classification Search ..... 297/289, 297/300.2, 300.5, 300.8, 303.5
See application file for complete search history.

(56) References Cited

U.S. PATENT DOCUMENTS

| | | | | |
|---|---|---|---|---|
| 3,453,024 | A * | 7/1969 | Williams | 297/300.5 |
| 4,650,248 | A * | 3/1987 | Borsani | 297/300.5 |
| 4,840,426 | A | 6/1989 | Burkhard et al. | |
| 5,397,165 | A * | 3/1995 | Grin et al. | 297/300.5 |
| 5,499,861 | A | 3/1996 | Locher | |
| 6,027,169 | A | 2/2000 | Roslund, Jr. | |
| 6,582,019 | B2 | 6/2003 | Warren et al. | |
| 6,712,428 | B2 * | 3/2004 | Moreschi | 297/303.4 |
| 6,945,605 | B2 | 9/2005 | Kinoshita et al. | |
| 7,124,472 | B2 | 10/2006 | Chao et al. | |
| 7,281,764 | B2 * | 10/2007 | Thole | 297/303.4 |

FOREIGN PATENT DOCUMENTS

| | | | |
|---|---|---|---|
| DE | 4424096 | A1 | 1/1996 |
| DE | 198 10 768 | A1 | 9/1999 |
| EP | 0460717 | A2 | 12/1991 |
| EP | 0 568 233 | A1 | 11/1993 |
| EP | 0582818 | A1 | 2/1994 |
| EP | 1 258 211 | A2 | 11/2002 |
| EP | 1 396 213 | | 3/2004 |
| GB | 2141171 | A | 12/1984 |

* cited by examiner

*Primary Examiner* — Laurie Cranmer
(74) *Attorney, Agent, or Firm* — Browdy and Neimark, PLLC

(57) ABSTRACT

The synchronizing device comprises a seat carrier for carrying a seat of said office chair, a seat arm to be connected to a chair column of said office chair, said seat carrier being pivotable in relation to said seat arm about a transverse axis, a backrest arm connected to said seat arm and to said seat carrier such as to be pivotable about a transverse axis, a spring adapted to counter a synchronized movement of said seat carrier and backrest arm, and a sliding member extending substantially in a longitudinal direction of said seat and being articulated to said seat arm, said seat carrier being slidable in relation to said sliding member substantially in said longitudinal direction of said seat.

8 Claims, 5 Drawing Sheets

SYNCHRONIZING DEVICE FOR AN OFFICE CHAIR

Figure 1:
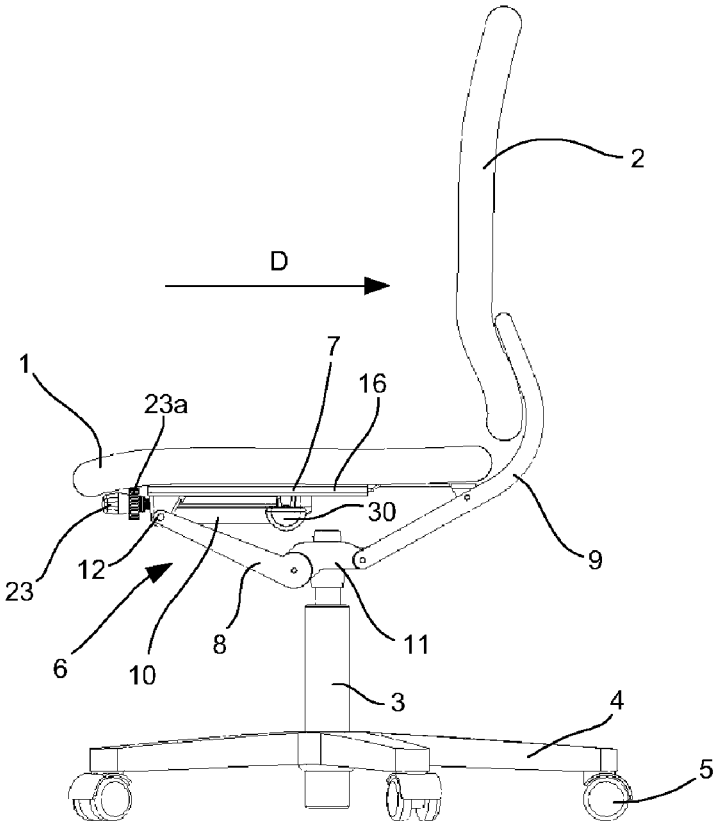

The present invention relates to a synchronizing device for an office chair, comprising

- a seat carrier for carrying a seat of said office chair,
- a seat arm to be connected to a chair column of said office chair, said seat carrier being pivotable in relation to said seat arm about a transverse axis,
- a backrest arm connected to said seat arm and to said seat carrier such as to be pivotable about a transverse axis,
- a spring adapted to counter a synchronized movement of said seat carrier and backrest arm,
- a sliding member extending substantially in a longitudinal direction of said seat and being articulated to said seat arm, said seat carrier being slidable in relation to said sliding member substantially in said longitudinal direction of said seat,
- a first counter bearing adapted for support of one end of said spring, said first counter bearing being retained, during said synchronized movement, in a fixed position in relation to said seat carrier, and
- a second counter bearing adapted for support of another end of said spring, said second counter bearing being retained, during said synchronized movement, in a fixed position on said sliding member.

Synchronizing devices are generally used to provide a synchronized, mutually dependent movement of the seat carrier and backrest arm of an office chair, during which movement the backrest pivots to a larger extent than the seat. A chair seat is resting on a seat carrier, and a backrest is mounted on a backrest arm. When a user leans backwards, thereby exerting a force on the backrest, the backrest arm and backrest pivots about a transverse axis positioned near a lower part of the backrest. Synchronously, the chair carrier and chair seat slides backwards and, at the same time, pivots a smaller angle than the pivot angle of the backrest about a transverse axis positioned near the front end of the chair seat. The proportion between the pivot angle of the backrest and that of the seat is usually between about 1:2.5 and 1:3. Preferably, the chair is spring loaded to provide a seemingly weightless synchronized movement such that the chair's seat and back rest dynamically follow the movement of the user when leaning forwards and backwards. The weightless movement is typically provided by spring means, which counter gravitational forces exerted by the user on the chair during synchronous movement. Synchronizing devices provide easy, comfortable and ergonomic adjustment of office chairs.

A synchronizing device of the type described in the introduction is known from EP 1396213 B1. Four parallel helical springs positioned beneath the seat carrier counter backwards synchronized movement of the seat carrier and the backrest carrier. The seat arm is connected to a chair column, and the backrest arm is connected to the seat arm and to the seat carrier. For each spring a sliding member in the form of a sliding rod extends longitudinally in the sliding direction of the seat carrier through the hollow interior of the helical spring. Each sliding rod is via a respective turning-and-sliding joint articulated, at one end, to the seat arm and is secured, at the other end, to a counter bearing providing rear support for the respective spring. The turning-and-sliding joint comprises a pin of the sliding rod turning and sliding in a longitudinal slot provided in the front part of the seat carrier. Respective counter bearings on the seat carrier provide front support for each spring. The seat carrier is able to slide in the turning-and-sliding joint in relation to the sliding rod and the seat arm. Two alternatives are provided for pretensioning of the springs. The first alternative provides cam-like members positioned at the front or rear end of the sliding rods, the cams being provided on a transverse adjustment rod. On rotation of the adjustment rod the cams displace the sliding rods in their longitudinal direction, thereby displacing the counter bearing of the sliding rod to compress or extend the helical springs. The second alternative provides a gear positioned near the front end of the seat. The gear transforms rotational movement of an adjustment rod into translational movement of the sliding rods. At their respective rear ends the sliding rods are provided with threads engaging respective complementary threads of the rearwards counter bearing, thereby providing displacement of the sliding rod in its longitudinal direction, shortening the distance between the counter bearings and compressing the respective springs.

The synchronizing device of EP 1396213 B1 has a number of disadvantages. The sliding rods tend to slide different distances in the turning-and-sliding joints if a skew force is applied to the backrest, i.e. an undesired rotation in a plane of the seat may occur, and even more so if applying fewer springs than four, e.g. a single spring. This results in noise and may jam the synchronizing device. The use of several springs and complicated adjustment arrangements makes the device expensive to produce and large in size, making it aesthetically unappealing and lessening the freedom of design. Further, the turning-and-sliding joints are exposed to excessive wear and may create creaking noises when actuated because of large forces being exerted on small contact faces of the pin and the slot of the joint. This is a significant disadvantage because a user typically changes his sitting position many times during a day. Furthermore, the adjusting knobs do not follow the movement of the seat carrier and thus change position in relation to the seat and backrest during the synchronized movement. Also, it is not possible to lock the seat and backrest when a desired position has been reached.

It is the object of the present invention to provide a synchronizing device of the above-mentioned type, in which the sliding movement of the seat carrier in relation to the sliding member is improved, and which provides an improved freedom of design.

To meet this object the synchronizing device is characterized in that said sliding member is provided exteriorly of said spring and comprises a longitudinally extending contact surface, which is slidable on a corresponding longitudinally extending contact surface of said seat carrier.

According to the invention, since the sliding member, on which the second counter bearing is fixed, is provided exteriorly, i.e. not inside, the spring, more freedom is provided in the design of contact surfaces of the seat carrier and the sliding member. Providing longitudinally extending contact surfaces increases the contact area in a given design, the seat carrier and sliding member exerting reduced pressure on each other during synchronized movement of the seat and backrest. This reduces wear on the contact surfaces and any noises created during movement. Since wear is reduced, a larger variety of materials, preferably less wear resistant and less noisy materials such as plastic, are available for construction of the parts.

Further, the synchronizing device according to the invention provides for improved control possibilities of the sliding movement of the seat carrier in relation to the sliding member. Longitudinal contact surfaces provides excellent possibility of applying more effective means for retaining movement of the seat carrier in any direction other than the desired sliding direction. Even if only a single spring is applied to the device, the sliding direction can thus still be effectively controlled. Applying only a single spring makes the design of the synchronizing device less complicated and provides economic advantages and reduces the space taken up by the device, the latter improving the appearance of the office chair and the freedom of design.

With the synchronizing device according to the invention it is possible to provide easy and fast assembly of the device, i.a. because it is possible to provide pretension of the spring only after assembly of the device.

Finally, providing the sliding member exteriorly in relation to the spring improves freedom of design regarding for example the positioning of adjustment arrangements for adjusting the pretension of the spring and any locking arrangements for locking the seat and backrest in a desired position, since such arrangements to a higher degree can be positioned inside the spring. Also, the freedom of choice according to the type of spring is improved since it does not necessarily have to be hollow.

In a preferred embodiment of the synchronizing device according to the invention said sliding member comprises a second longitudinally extending contact surface, which is slidable on a corresponding second longitudinally extending contact surface of said seat carrier. The provision of further contact surfaces further increases the contact area and further improves control possibilities.

In another preferred embodiment said seat carrier comprises means for retaining said sliding member in directions other than said longitudinal direction of said seat.

In another preferred embodiment said sliding member is in the form of a housing member housing said spring. The housing can be used to hide parts of the synchronizing device such as the spring, improving the appearance of the chair, screening off moving parts, thereby improving safety, and providing control surfaces for any moving parts inside the housing.

In another preferred embodiment said first counter bearing is provided at a front end of said spring, and said second counter bearing is provided at a rear end of said spring. When a user leans backwards or reclines on the office chair this provides a spring force by means of compression of the spring. Alternatively, the counter bearings are oppositely positioned, providing an extension of the spring during backwards leaning.

In an especially preferred embodiment the synchronizing device further comprises an adjustment rod extending inside and substantially coaxially with said spring, said rod being retained against translational movement in relation to said seat carrier. Said adjustment rod preferably comprises a first, rotatable rod member with an exterior thread cooperating with an interior thread of said first counter bearing, said interior thread being non-rotatable such that said first counter bearing is movable in an axial direction of said rod member by means of rotation of said first rod member, thereby providing pre-tensioning of said spring. More preferably said adjustment rod comprises a second, non-rotatable rod member with a thread on part of its exterior surface, said second counter bearing comprising an interior thread, said interior thread being rotatable between two predefined positions, i.e. an unlocked position in which said threads are not mating and a locked position in which said threads are mating, said locked position providing a locking of the sliding movement of said adjustment rod and, with that, said seat carrier when in a desired position. The adjustment rod is simple, relatively small and is provided inside the spring, lessening the costs and improving the appearance of the chair. It further provides excellent adjustment possibilities for pretensioning of the spring and/or locking the seat carrier in a desired position. The adjustment rod follows the seat carrier, thus being disposed in the same position in relation to a user sitting on the chair, independently of the sitting position of the user. This improves the freedom of choice regarding positioning of any knobs attached to the adjustment rod. The provision of this novel adjustment rod is made possible by means of the novel design of the synchronizing device according to the present invention.

Figure 2:
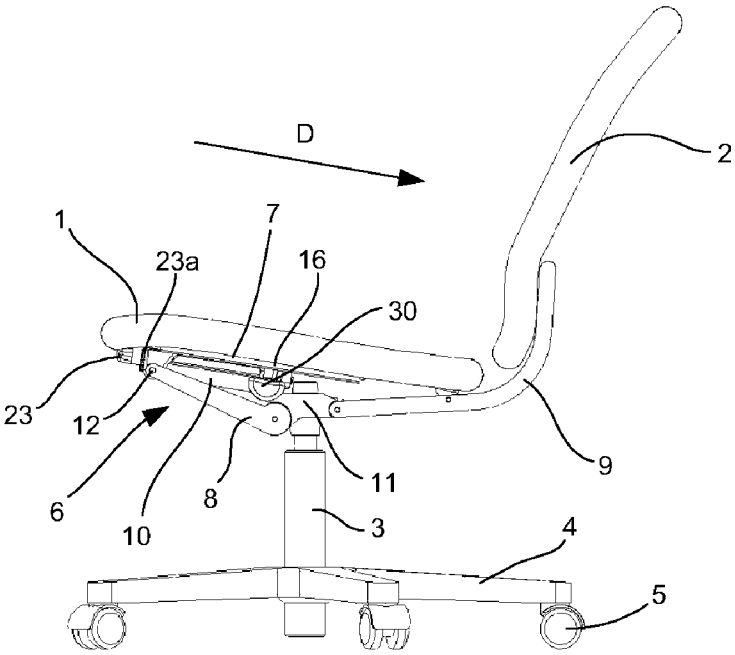
Figure 3:
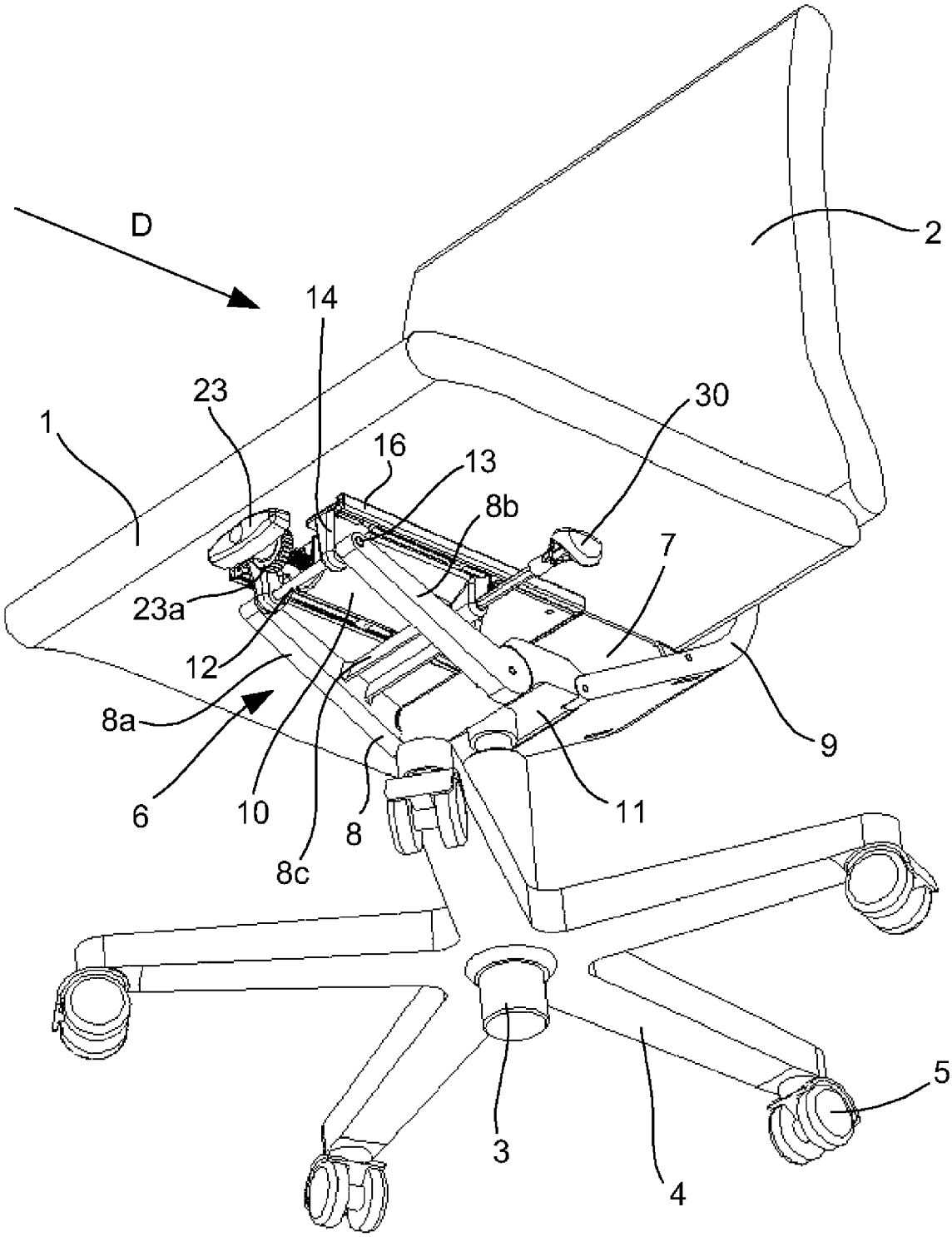
Figure 4:
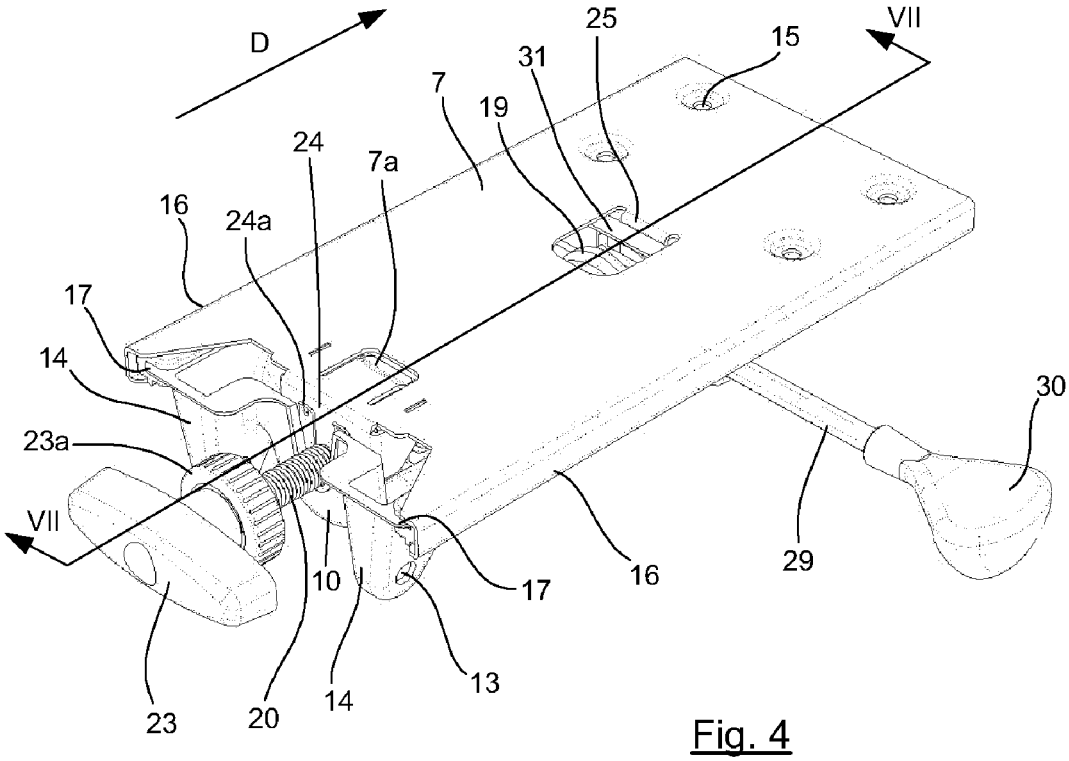
Figure 5:
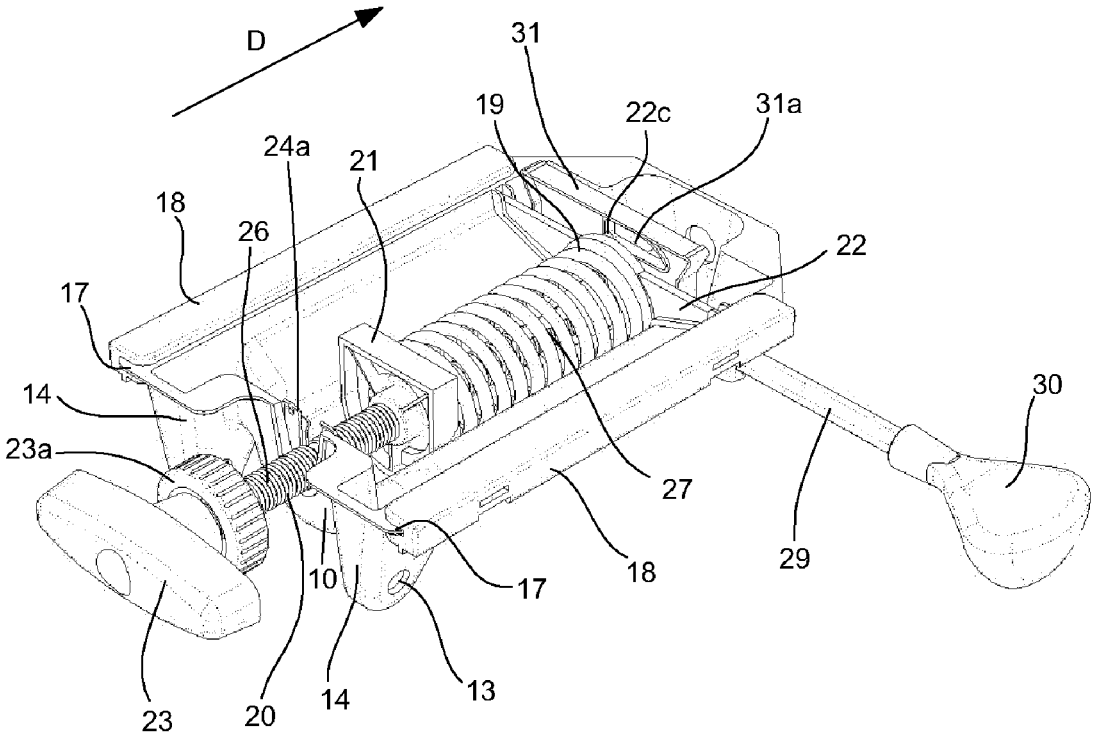
Figure 6:
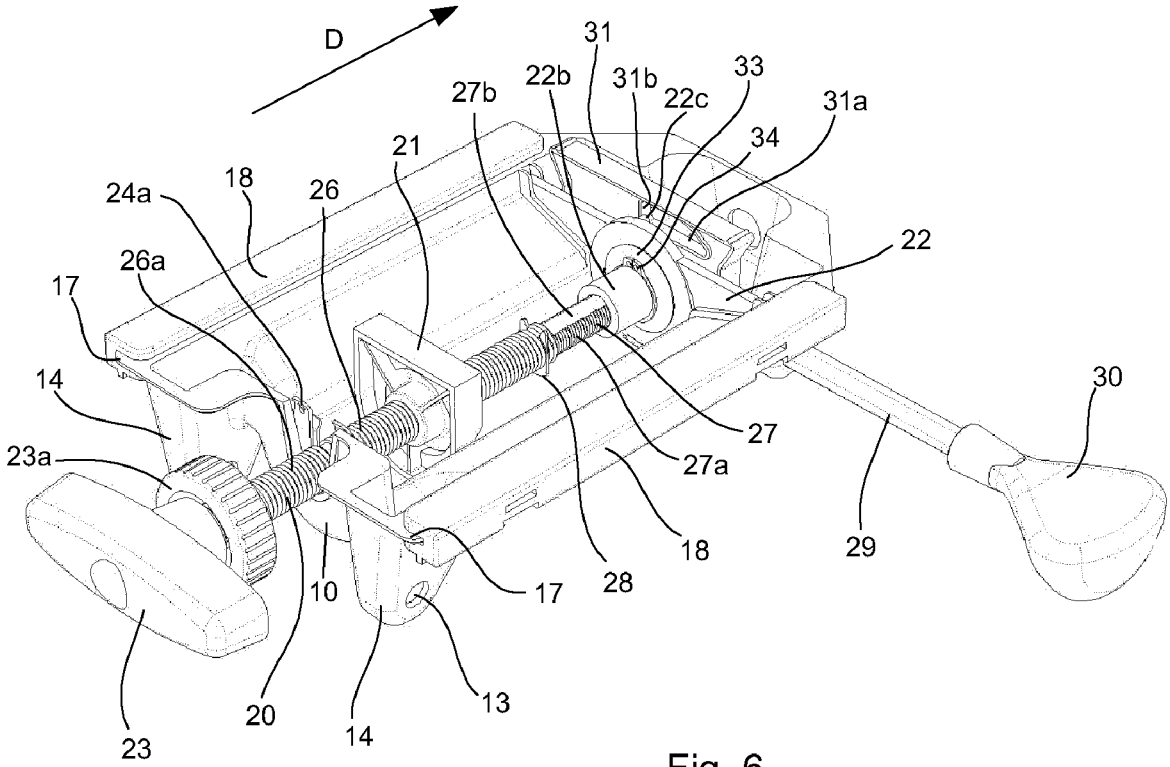
Figure 7:
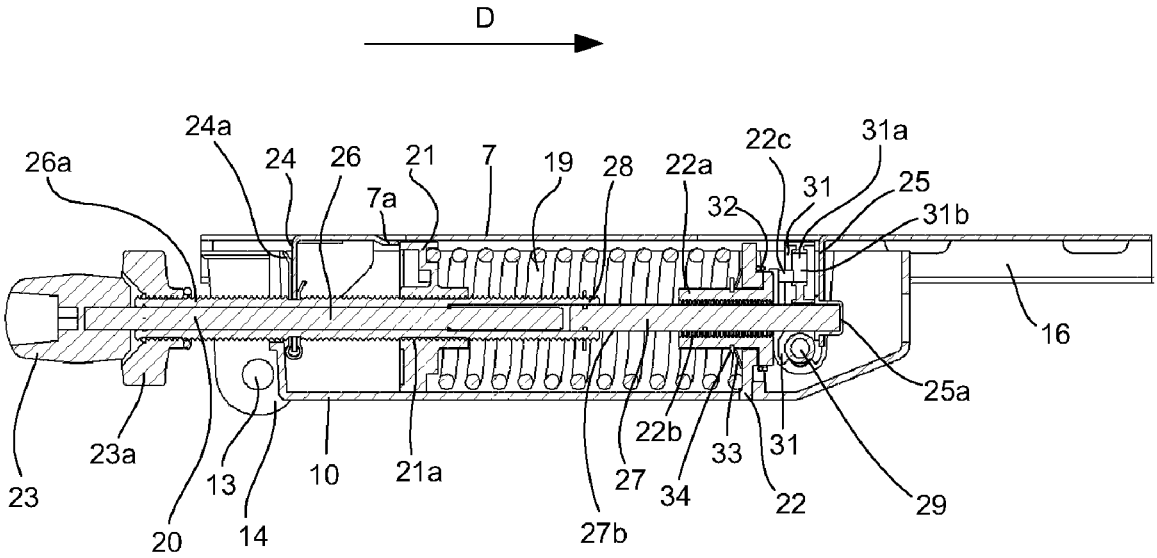
Figure 8:
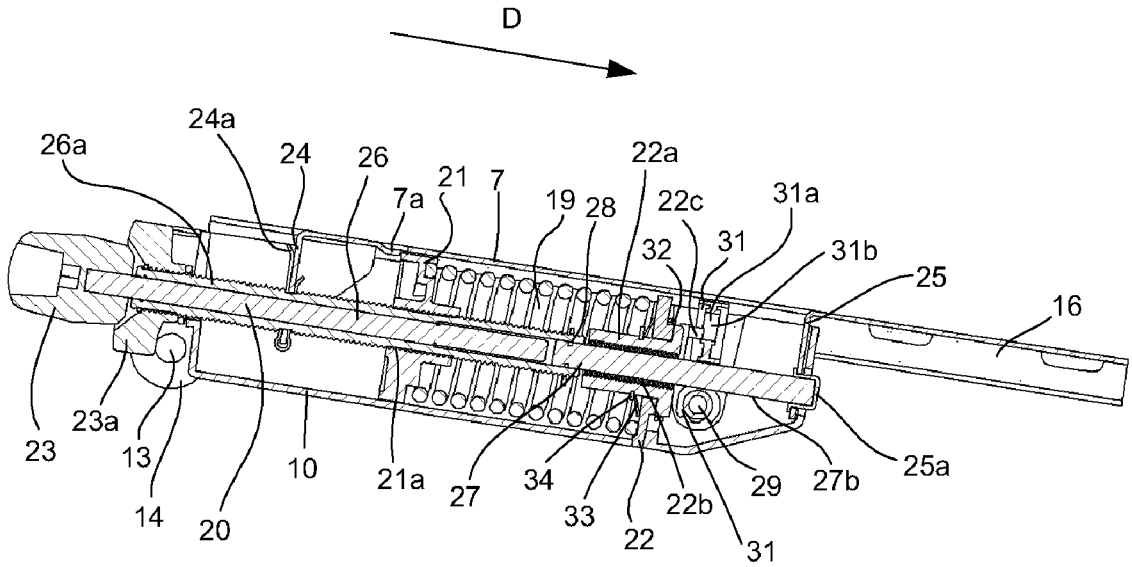

The invention will be explained in detail in the following by means of examples of embodiments with reference to the schematic drawing, in which FIG. 1 is a side view of an office chair provided with an embodiment of a synchronizing device according to the invention, the office chair being in an upright position, FIG. 2 is a side view of the office chair according to FIG. 1 shown in a reclined position, FIG. 3 is a view of the office chair according to FIG. 1 shown in perspective from below, FIG. 4 is a perspective view of part of the synchronizing device of the office chair according to FIG. 1 shown from above, the synchronizing device being in an upright position corresponding to the view of FIG. 1, FIG. 5 is a view similar to the view according to FIG. 4 with a seat carrier removed from the synchronizing device to show the interior of the device, FIG. 6 is a view similar to the view according to FIG. 5, a spring having also been removed from the synchronizing device, FIG. 7 shows a cross section of part of the synchronizing device according to FIG. 4 taken along the line VII-VII of FIG. 4, and FIG. 8 shows a view similar to the view according to FIG. 7, the synchronizing device being in a reclined position corresponding to the view of FIG. 2.

FIGS. 1 to 3 show different views of an office chair provided with an embodiment of a synchronizing device according to the invention, the office chair in FIGS. 1 and 3 being shown in an upright position and in FIG. 2 being shown in a reclined position.

Referring to FIGS. 1 to 3 the office chair comprises a seat 1, a backrest 2 and a chair column 3 connected to a base 4 with wheels 5. The seat 1 and the office chair in general have a front end at the left side and a rear or back end at the right side of FIGS. 1 and 2. The synchronizing device 6 comprises a seat carrier 7, a seat arm 8, a backrest arm 9 and a sliding member in the form of a housing 10. The housing 10 extends in a longitudinal sliding direction D of said seat, cf. FIG. 1. The seat arm 8 comprises two parallel arm parts 8*a*, 8*b*, which are connected centrally by means of a transverse connecting member 8*c*, cf. FIG. 3. At one end the arm parts 8*a*, 8*b* are articulated to the chair column 3 via an intermediate member 11, which is secured to the chair column 3. The purpose of the joint between the intermediate member 11 and the arm parts 8*a*, 8*b* is to allow for adjustment of the tilting of the seat 1. However, during synchronized movement of the seat 1 and backrest 2 the joint is locked in position. The arm parts 8*a*, 8*b* project forwards from the intermediate member 11 towards the front of the seat 1 and are articulated to a front part of the housing 10 by means of a shaft 12 extending through holes 13 of house projections 14, cf. FIG. 3. The housing 10 is thus able to pivot about a longitudinal axis of the shaft 12.

The L-shaped backrest arm 9 is articulated to the seat arm 8 via the intermediate member 11 and projects backwards to be articulated to a rear part of the seat carrier 7, and is thus able to pivot about a trans-verse axis, i.e. in the joint between the backrest arm 9 and the intermediate member 11. Having passed the seat carrier 7, the backrest arm 9 turns upwards and receives the backrest 2 on the shorter leg of its L-shape.

Parts of the synchronizing device 6 are shown in more detail in FIGS. 4 to 8. As can be seen from FIG. 4, the seat carrier 7 is generally shaped as a flat plate to abut a flat lower surface of the seat 1, the seat carrier 7 and seat 1 being fixed to each other by means of screws (not shown) extending through holes 15 of the seat carrier 7. At its lateral sides the seat carrier extends into respective longitudinal foldings 16, each folding 16 receiving a longitudinal laterally protruding part 17 of the housing 10. The foldings 16 thus form means for retaining the housing 10 in directions other than the direction D of the seat 1. Between each protruding part 17 and the respective folding 16 a wear element 18 is provided as a separately formed part of the housing 10, the wear element 18 preferably being manufactured from a wear resistant, low-friction material. In the embodiment shown the respective wear elements 18 extend in the entire longitudinal extent of each protruding part 17, cf. FIGS. 5 and 6. The wear elements 18 thus form longitudinally extending contact surfaces, which are able to slide on corresponding longitudinally extending contact surfaces, i.e. foldings 16, of the seat carrier 7. Thus, the seat carrier 7 is slidable in relation to the housing 10 in the direction D of the seat 1.

The housing 10 encloses or houses a spring in the form of a pretensioned helical spring 19, which is seen best in FIG. 5, and part of an adjustment rod 20, which is seen best in FIG. 6. The spring 19 is adapted to counter synchronized movement of the seat carrier 7 and backrest arm 9. The helical spring 19 extends in the direction D and is supported, at a front end, by a first counter bearing 21 and, at a rear end, by a second counter bearing 22. The first counter bearing 21 is retained, during said synchronized movement, in a fixed position in relation to the seat carrier 7, the pretensioned spring 19 pushing the first counter bearing 21 forwards, i.e. in the direction opposite to the direction D, against a stop 7*a* provided integrally with the seat carrier 7. The second counter bearing 22 is retained, during said synchronized movement, in a fixed position on the housing 10, a lower part of the second counter bearing 22 being embedded in a lower part of the housing 10, cf. FIG. 7.

The adjustment rod 20 extends coaxially with and through the hollow interior of the helical spring 19, one end of the adjustment rod 20 extending out of a front part of the housing 10, a first turning knob 23 being provided at this end. The adjustment rod 20 is retained against translational movement in relation to the seat carrier 7 by means of a pair of retainers 24 and 25 positioned near a front end and near a rear end, respectively, of the adjustment rod 20, cf. FIGS. 5 and 7, and thus follows the seat carrier 7 and the seat 1 during any synchronized movement. The retainers 24, 25 form part of and are integral with the seat carrier 7 and are in the form of pieces of the seat carrier 7 bent down to be perpendicular in relation to general plate shape of the seat carrier 7. The adjustment rod 20 is secured to the retainer 24 by means of a clip 24*a*. The adjustment rod 20 comprises two rod members; a first, rotatable rod member 26 and a second, non-rotatable rod member 27, cf. FIGS. 6 and 7. The first rod member 26 constitutes a front part of the adjustment rod 20 with an external thread 26*a* and is embedded rotatably in the clip 24*a*. The first rod member can be pulled telescopically forwards, i.e. in the direction opposite to the direction D, out of the exterior thread 26*a* to make the adjustment knob more accessible and easier to handle. A second turning knob 23*a* is provided with an internal thread engaging the external thread 26*a* of the first rod member 26. This turning knob 23*a* can be used to limit the sliding movement of the adjustment rod 20 and thereby the total synchronizing movement by positioning it closer or farther away from the housing 10 in order to abut the exterior of the housing 10 during tilting of the seat 1. Turning the turning knob 23*a*, the turning knob 23*a* engages the external thread 26*a*, and the rod member 26 moves in the direction D.

Instead of being positioned at the front part of the seat 1, the first turning knob 23 and the second turning knob 23*a* may, as an alternative, be positioned at a lateral side of the seat 1. This may be achieved by the provision of a gear corresponding to the synchronizing device shown in FIG. 12 of the above-mentioned prior art document EP 1396213 B1.

The second rod member 27 constitutes a rear part of the adjustment rod 20 with an external thread 27*a*, an upper and a lower part of which having been filed off so as to form two respective flat surfaces 27*b*. The second rod member 27 is fixed to the retainer 25 by means of a securing member 25*a*, which is preferably manufactured from plastic, the securing member 25*a* extending through a correspondingly shaped aperture of the retainer 25. The securing member 25*a* has a cross section corresponding to that of the second rod member 27 for receiving a rear end of the second rod member 27 and thus securing the second rod member 27 against rotation about its own axis. The external thread 26*a* of the first rod member 26 is rotatable, but secured axially, in relation to the second rod member 27 by means of a rotating joint in the form of a clip 28.

The exterior thread 26*a* of the first rod member cooperates with an interior thread 21*a* integral with the first counter bearing 21, the interior thread 21*a* being non-rotatable such that the first counter bearing is movable in an axial direction of the first rod member 26 by means of rotation of the first rod member 26. A user is thus able to pretension the spring 19 by rotating the turning knob 23. Pretensioning of the spring 19 is relevant when adjusting the spring force to fit persons of different weights and/or preferences.

The second counter bearing 22 comprises a separate bearing part 22*a* with an interior thread 22*b*, cf. FIGS. 7 and 8. The bearing part 22*b* is rotatable in relation to the remaining part of the counter bearing 22. The bearing part 22*a* further comprises a pin 22*c* extending in an upper part of the housing 10 towards the rear side of the office chair, cf. also FIGS. 5 and 6. A second adjustment rod 29 extends into the housing 10 from beneath a lateral side of the seat 1, cf. also FIGS. 1 to 4. The projecting end of the second adjustment rod 29 is provided with an adjustment knob 30. The opposite end is fixed to an adjustment member 31 having a transverse slit 31*a*, the adjustment member 31 being fixed to the second adjustment rod 29. The adjustment member 31 is able to slide on the housing 10 and the seat carrier 7 in the axial direction of the second adjustment rod 29. The pin 22*c* of the bearing member 22*a* is spring loaded against one internal surface 31*b* of the slit 31*a* of the adjustment member 31 by means of a spring ring 32 provided on a rear side of the counter bearing 22. A disc spring 33 is provided on a front side of the counter bearing 22 and is kept in position by means of a locking ring 34.

A user is thus able to bring the seat 1 and backrest 2 of the office chair into and out of a locked position by means of actuation of the adjustment knob 30. The locking is achieved by engagement of the internal thread 22*b* of the bearing part 22*a* with the external thread 27*a* of the second rod member 27.

An unlocked position of the chair is shown in the figures, i.e. a position in which the internal thread 22*b* is out of engagement with the external thread 27*a*. Pulling the second adjustment rod 29 away from the housing 10 pulls the pin 22*c*, via abutment with the internal surface 31*b* of the slit 31*a*, in the same direction, the bearing part 22*a* thereby rotating about 90° such as to end up in a locked position. When the adjustment member 31 has been pulled a certain distance, the internal thread 22*b* faces the exterior thread 27*a* of the second rod member 27, and the disc spring 33 is actuated, retaining the adjustment member and thereby the entire synchronizing device 6 in the chosen position. Engagement of the internal thread 22*b* with the exterior thread 27*a* prevents movement of the rod 20 and thereby the seat carrier in the sliding direction D; thus the synchronizing device is locked in position. Now, pushing the second adjustment rod 29 towards the housing 10 displaces the abutment surface 31*b* away from the pin 22*c*. When a user reclines with a predetermined force, the disc spring 33 snaps out of locking engagement, and the pin 22*c* rotates in the opposite direction because of the spring loading provided by the spring ring 32. The bearing part 22*a* thereby rotates the opposite way such as to, again, end up in the unlocked position, i.e. a position in which the internal thread 22*b* is released from engagement with the external thread 27*a*.

In the unlocked position the user is thus able to lean backwards or forwards on the office chair, continuing the synchronized movement until a new preferred sitting position has been reached. Again, the user is able to lock the chair in this preferred position by actuation of the locking rod 30. As will be clear to the skilled person, the above pretensioning and locking mechanisms provide for stepless adjustment of pretension of the spring 19 and sitting position of a user, respectively.

Synchronized movement of the seat 1 and backrest 2 is explained in the following with reference to FIGS. 1, 2, 6 and 7. The office chair being in the upright position of FIGS. 1 and 7, a user leaning backwards or reclining on the chair exerts a force on the backrest 2, the back rest 2 and the backrest arm 9 pivoting backwards through a first angle, pulling the seat 1 and thus the seat carrier 7 to slide in the rearwards direction to assume a position as shown in FIGS. 2 and 7. The seat 1 and seat carrier 7 also pivot or tilt downwards about the shaft 12, the pivot angle of the seat 1 and seat carrier 7 being smaller, i.e. about 1:2.5, than the pivot angle of the backrest 2 and backrest arm 9. In said backwards movement the seat 1 and seat carrier 7 slide on the housing 10, i.e. the surfaces of the foldings 16 slide on the wear elements 18 of the protruding parts 17. The first counter bearing 21 slides together with the seat 1 and seat carrier 7, pushing the front end of the spring 19 towards the second counter bearing 22 and the rear part of the spring 19, thus contracting the helical spring 19, cf. FIG. 8. Contraction of the spring 19 provides a spring force acting in a direction, which is opposite in relation to the sliding direction D. The user may then lock the chair in the reclined position of FIGS. 2 and 8 by means of the above-described locking system. The chair thus remains in the reclined position until the lock is released as described in the above. The user may then, if he so prefers, lean forwards, again assuming the sitting position of FIGS. 1 and 7.

Assembly of the part of the synchronizing device shown in FIGS. 3 and 7 may be carried out in the following steps:

1. The second rod member 27 is inserted into the securing member 25*a*, 2. the spring ring 22*c* is positioned on the bearing part 22*a*, which is inserted in the remaining part of the counter bearing 22, and the disc spring 33 and the locking ring 34 are secured to the counter bearing 22, 3. the second rod member 27 is guided through the counter bearing 22, 4. the external thread 26*a* of the first rod member 26 is connected to the second rod member 27 via the clip 28, 5. the first rod member 27 and the external thread 26*a* are guided through the unloaded helical spring 19, a first end of the spring 19 abutting the second counter bearing 22, 6. the second rod member 27 and the external thread 26*a* are guided through the first counter bearing 21, the first counter bearing 21 abutting the second end of the spring 19, the spring 19 still being in an unloaded state, 7. the second turning knob 23*a* is screwed on the external thread 26*a*, 8. the first rod member 26 is secured to the first turning knob 23, and the first rod member 26 is guided through the external thread 26*a*, 9. the adjustment member 31 is positioned near the rear end of the adjustment rod 20, 10. the seat carrier 7 is secured to the adjustment rod 20 by means of the clip 24*a* and the securing member 25*a*, 11. the adjustment knob 30 is secured, at one end, to the second adjustment rod 29, and the other end of the second adjustment rod 29 is guided into the housing 10, 12. a wear element 18 is mounted on each of the protruding parts 17, 13. the wear elements 18 and protruding parts 17 are slid into the foldings 16 of the seat carrier 7, and finally 14. the rod member 26 is turned by means of the turning knob 23 in order to actuate the engagement between the external thread 26*a* and the internal thread 21*a*, thus forcing the counter bearing 21 towards the rear end of the seat 1 until, having passed the stop 7*a*, the counter bearing 21 snaps into the position as shown for example in FIG. 7, abutting the stop 7*a*, and thus providing a predefined minimum pretension of the helical spring 19.

To form the assembled office chair, which is shown in FIGS. 1 and 3, the seat arm 8 and the backrest arm 9 are connected to the part of the synchronizing device assembled as described in the above to form the embodiment of the synchronizing device 6 according to the invention as shown in FIGS. 1 and 3. Finally, the remaining parts of the office chair are connected to the synchronizing device 6. As is clear from the above, assembly of the shown embodiment of the synchronizing device according to the invention is easy and uncomplicated. Further, it is possible to wait until after assembly of the synchronizing device to pretension the spring, which substantially simplifies the assembly process.

In the embodiment shown and described in the above the seat carrier is formed as an element separate from the chair seat. Alternatively, the seat carrier is integral with the seat and may even be provided as a bottom part of the seat.

The invention is not limited to embodiments with a single spring. The spring force may be provided by means of any suitable number of springs. As an example, one smaller spring may be positioned on each side of the "main spring" (i.e. the spring as described in relation to the embodiment of the figures), the smaller springs being activated when having reached a predefined reclined position of the seat and backrest. This may be advantageous in office chairs, which are to be used by persons of very different weights. In another example only one further spring is provided beneath the main spring. In yet another example two or more "main springs" are provided side-by-side in one common housing or in several separate housings.

The invention claimed is:

1. A synchronizing device (6) for an office chair, comprising a seat carrier (7) for carrying a seat (1) of said office chair, a seat arm (8) to be connected to a chair column (3) of said office chair, said seat carrier (7) being pivotable in relation to said seat arm (8) about a transverse axis, a backrest arm (9) connected to said seat arm (8) and to said seat carrier (7) such as to be pivotable about a transverse axis, a spring (19) adapted to counter a synchronized movement of said seat carrier (7) and backrest arm (9), a sliding member (10) extending substantially in a longitudinal direction (D) of said seat (1) and being articulated to said seat arm (8), said sliding member (10) being arranged such that said synchronized movement of said seat carrier (7) and backrest arm (9) provides a sliding movement of said seat carrier (7) in relation to said sliding member (10) substantially in said longitudinal direction (D) of said seat (1), a first counter bearing (21) adapted for support of one end of said spring (19), said first counter bearing (21) being retained, during said synchronized movement, in a fixed position in relation to said seat carrier (7), and a second counter bearing (22) adapted for support of another end of said spring (19), said second counter bearing (22) being adapted to be retained, during said synchronized movement, in a fixed position on said sliding member (10) such as to counter movement of said first counter bearing towards said second counter bearing in order to provide compression of said spring, characterized in that said sliding member (10) is provided exteriorly of said spring (19) and comprises a longitudinally extending contact surface (18), which is slidable on a corresponding longitudinally extending contact surface (16) of said seat carrier (7).

2. The synchronizing device according to claim 1, wherein said sliding member comprises a second longitudinally extending contact surface, which is slidable on a corresponding second longitudinally extending contact surface of said seat carrier.

3. The synchronizing device according to claim 1, wherein said seat carrier comprises means for retaining said sliding member in directions other than said longitudinal direction of said seat.

4. The synchronizing device according to claim 1, wherein said sliding member is in the form of a housing member housing said spring.

5. The synchronizing device according to claim 1, wherein said first counter bearing is provided at a front end of said spring, and said second counter bearing is provided at a rear end of said spring.

6. The synchronizing device according to claim 1, further comprising an adjustment rod extending inside and substantially coaxially with said spring, said rod being retained against translational movement in relation to said seat carrier.

7. The synchronizing device according to claim 6, wherein said adjustment rod comprises a first, rotatable rod member with an exterior thread cooperating with an interior thread of said first counter bearing, said interior thread being non-rotatable such that said first counter bearing is movable in an axial direction of said rod member by means of rotation of said first rod member, thereby providing pre-tensioning of said spring.

8. The synchronizing device according to claim 6, wherein said adjustment rod comprises a second, non-rotatable rod member with a thread on part of its exterior surface, said second counter bearing comprising an interior thread, said interior thread being rotatable between two predefined positions, i.e. an unlocked position in which said threads are not mating and a locked position in which said threads are mating, said locked position providing a locking of the sliding movement of said adjustment rod and, with that, said seat carrier when in a desired position.

* * * * *